United States Patent [19]

Hibino et al.

[11] Patent Number: 4,824,538

[45] Date of Patent: Apr. 25, 1989

[54] METHOD FOR ELECTRODEPOSITION COATING

[75] Inventors: Ikukazu Hibino; Yoshinobu Takahashi, both of Toyota, Japan

[73] Assignee: Toyota Jidosha Kabushiki Kaisha, Japan

[21] Appl. No.: 130,278

[22] Filed: Dec. 8, 1987

[30] Foreign Application Priority Data

Dec. 10, 1986 [JP] Japan ..... 61-292502

[51] Int. Cl.[4] ..... C25D 13/06; C25D 17/16

[52] U.S. Cl. ..... 204/180.2; 204/180.9; 204/300 EC; 204/279 EC

[58] Field of Search ..... 204/299 EC, 300 EC, 204/180.2, 180.9, 181.1, 181.7

[56] References Cited

U.S. PATENT DOCUMENTS 3,728,242 4/1973 Loop et al. ..... 204/181
4,486,284 12/1984 Mori et al. ..... 204/300 EC

FOREIGN PATENT DOCUMENTS 54-112949 9/1979 Japan .
56-156798 3/1981 Japan .
58-4928 1/1983 Japan .
58-10476 2/1983 Japan .
58-701 7/1983 Japan .
59-177398 10/1984 Japan ..... 204/299 EC
1203789 9/1970 United Kingdom ..... 204/300 EC

OTHER PUBLICATIONS

Metal Finishing, G.E.F. Brewer, Sep. 1980, pp. 55–59.
Patent Abstracts of Japan, Field C, vol. 9, No. 32, Feb. 9, 1985.

*Primary Examiner*—John F. Niebling
*Assistant Examiner*—Ben C. Hsing
*Attorney, Agent, or Firm*—Finnegan, Henderson, Farabow, Garrett & Dunner

[57] ABSTRACT

A method for the electrodeposition coating of workpieces conveyed in an electrodeposition bath, wherein voltage application means is provided in a plurality of stages in the conveying direction of the workpieces. In the method, the type of workpiece being conveyed is detected, and the length of time to apply voltage to the workpiece in the bath according to the type of workpiece by changing the number of stages to be electrically coupled among the plurality of stages of the voltage application means. By this method, it becomes possible to provide each workpiece with most suitable electrodeposition film thickness even in a line where workpieces having different required film thicknesses are present.

6 Claims, 3 Drawing Sheets

METHOD FOR ELECTRODEPOSITION COATING

BACKGROUND OF THE INVENTION

1. Field of the Invention

The present invention relates to coating metallic workpieces by electrodeposition; coating of vehicle parts, etc.; and more specifically to a method of providing the most suitable thickness of electrodeposition film to each one of a plurality of workpieces being conveyed in a continuous process where the desirable thickness of the electrodeposition film on the workpieces vary.

Description of the Prior Art

2. Conventional methods for applying by electrodeposition a coating to a plurality of workpieces being conveyed in a continuous process typically call for placing electrode plates at both the right and left sides or, as the case may be, at the bottom of an electrodeposition bath that contains the paint, bringing in the workpieces to be coated from one side of the electrodeposition bath into the paint, while applying direct current voltage between the workpieces and the electrode plates; and bringing out the workpieces from the other side of the electrodeposition bath. (For examples, JP-B-SHO No. 58-10476, JP-A-SHO No. 54-112949 and JP-A-SHO No. 56-156798)

According to such a conventional method for electrodeposition coating, typically workpieces are conveyed continuously by a conveying means equipped with, for example, a suspension hanger. (For example, Japanese Utility Model Publication SHO No. 58-701 and Japanese Utility Model Publication SHO No. 58-4928) Particularly when the workpieces to be coated are smaller than a vehicle body, such as vehicle parts, typically the workpieces are conveyed in a continuous process at considerable short intervals for the purpose of improving production efficiency. Thus a plurality of workpieces, which are successively brought into the electrodeposition bath, are completely immersed in the paint in the electrodeposition bath simultaneously and are brought out of the bath in order as electrodeposition coating is completed. In applying electrodeposition coating to small parts such as those described above, it is common for there to be a large variety kinds of workpieces and that the desirable thickness of electrodeposition film on the workpieces vary depending on the kind of workpiece. According to the conventional method for electrodeposition coating, however, the length of time that the current flows to the workpieces in the electrodeposition bath is fixed to a predetermined length (for example, 3 minutes), and, therefore, the thickness of the film to be obtained is nearly uniform regardless of the kind of workpiece.

Such a conventional method for electrodeposition coating presents the following problem:

In case of the chassis parts of a vehicle, including driving operation parts and engine supporting parts, thicker electrodeposition film is advantageous from the rust resistance point of view. On the other hand, excess thickness of film at certain parts, such as screwing parts of nuts and bolts, is undesirable, because if the thickness of the electrodeposition film on the workpieces reaches the range between approximately 30 μm and 45 μm, such disadvantages as loosened bolts, caused by deformation of the paint film due to fatigue; and the necessity of increasing clamping torque at the screwing part of the nuts can be expected. For this reason even in cases where coating is applied to workpieces containing such parts together with other workpieces which do not include such parts, conditions of coating are typically so set as to obtain a film thin enough not to cause the problem described as above on the workpieces including the above parts, e.g. 30 μm or less. Therefore, the thickness of the films on the workpieces without the screwing parts would also be suppressed to 30 μm or less, which is not desirable from the standpoint of rust resistance.

Further, in cases where workpieces which are relatively free from the problem of rust are mixed with workpieces which require high rust resistency, the coating conditions are generally set so as to give necessary rust resistency to the latter type of workpieces, and, as a result, the films on the former type of the workpieces, which require a coating only as thick as 15–20 μm, are unnecessarily thick and thus disadvantageous in terms of cost.

As a solution to the above problems one of the conventional methods generally applied to provide different thicknesses of electrodeposition films according to the kinds of workpieces to be coated is the method which calls for arranging workpieces by their type into lots and then applying electrodeposition coating to such lots, changing the condition of the coating, such as the voltage applied for coating, conveyor speed, etc., in accordance with the kind of workpieces in the current lot. This method, however, presents a problem in that production efficiency is poor because it is impossible to apply coating to the subsequent lot of workpieces while the process of changing the coating conditions is in progress and, in addition, the process of lot production itself is inefficient.

Another possible solution to the present problem is the method disclosed in JP-A-SHO No. 59-177398, which provides the method of controlling the electrodeposition film thickness by means of electrically detecting the kind of workpieces to be coated before they are brought into the electrodeposition bath and setting the most suitable voltage to be applied to the workpieces in the submersion area. However, this method, disclosed in JP-A-SHO 59-177398, calls for applying electrodeposition coating to workpieces in the submersion area by a single means of voltage application. Therefore, no problem should occur as long as only one workpiece is present in the submersion area at one time, but as described above if a plurality of workpieces are to be continuously conveyed in short intervals, thus resulting in the presence of multiple workpieces on the conveying route at the same time in the submersion area, it is impossible to control the applied voltage to each workpiece and thus impossible to change the film thickness according to the kind of workpiece.

SUMMARY OF THE INVENTION

An object of the present invention is to provide a method of electrodeposition coating that allows the control of the length of time of voltage application to each of workpieces to be coated which are conveyed in a continuous process at relatively short intervals according to the type of workpiece, thereby providing each workpiece with an electrodeposition film of desirable thickness.

To accomplish the above object, in a method for electrodeposition coating according to the present invention, the process for electrodeposition coating proceeds as follows.

Workpieces which call for electrodeposition coating of different film thickness from each other are continuously conveyed at certain intervals; a plurality of the conveyed workpieces are simultaneously submerged in the electrodeposition bath and electrodeposition coating is applied in the electrodeposition bath by applying voltage to the electrical circuit that is comprised of a voltage application means having a plurality of stages along the conveying route; conveyor carried electrode means that corresponds to each workpiece in the submersion area and are electrically coupled to the voltage application means; and the workpieces that correspond to the electrode means. In applying electrodeposition coating, the length of time of voltage application to the workpieces in the electrodeposition bath is controlled according to the type of the workpiece by means of detecting the type of workpiece being conveyed with regard to the desired thickness of coating film for the workpiece; and, according to the type of workpiece, changing the number of stages applying current among the stages of voltage application means.

The voltage application means include bus bars, which can be electrically coupled to the conveyor carried electrode means and are positioned in a plurality of stages along the conveying route. The length of time of voltage application is controlled by controlling the number of stages of the bus bars to which voltage is applied: for example, voltage is always applied to the first stage of the bus bars; and voltage is applied to the final stage bus bar (in other words, the number of stages between the first to the last bus bar to which voltage is applied) is changed according to the type of workpiece.

According to this method, the type of workpiece being continuously conveyed is detected before the workpiece reaches the final stage of the voltage application means to which voltage is applied; and the length of time of voltage application in the electrodeposition bath to each workpiece is controlled according to the type of the workpiece. Therefore, regardless of whether a plurality of workpieces, whose most desirable film thickness of coating differs from each other, are simultaneously existent in the submersion area, the length of time of voltage application to each workpiece is controlled to the most desirable length respectively, and thus the film thickness of electrodeposition coating of each workpiece is controlled to the most desirable thickness according to the type of the workpiece.

BRIEF DESCRIPTION OF THE DRAWINGS

The accompanying drawings, which are incorporated in and constitute a part of this specification, illustrate several embodiments of the invention and together with the description serve to explain the principles of the invention.

DETAILED DESCRIPTION OF THE PREFERRED EMBODIMENTS

Figure 1:
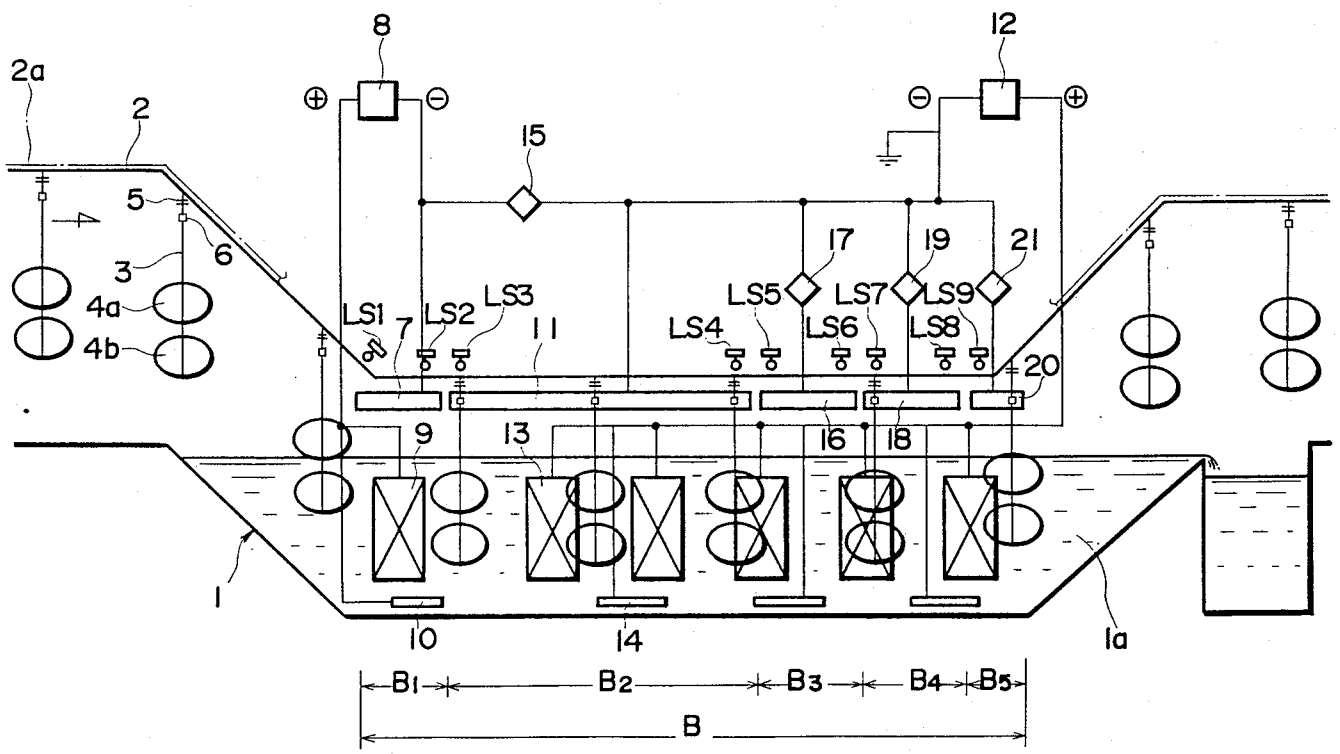
FIG. 1 is a schematic side view of an electrodeposition coating apparatus to be used in a method for electrodeposition coating according to a first embodiment of the present invention.

The illustrated preferred embodiments of the present invention will be described hereunder referring to the attached drawings wherein like reference numerals refer to similar parts;

First Embodiment

Figure 2:
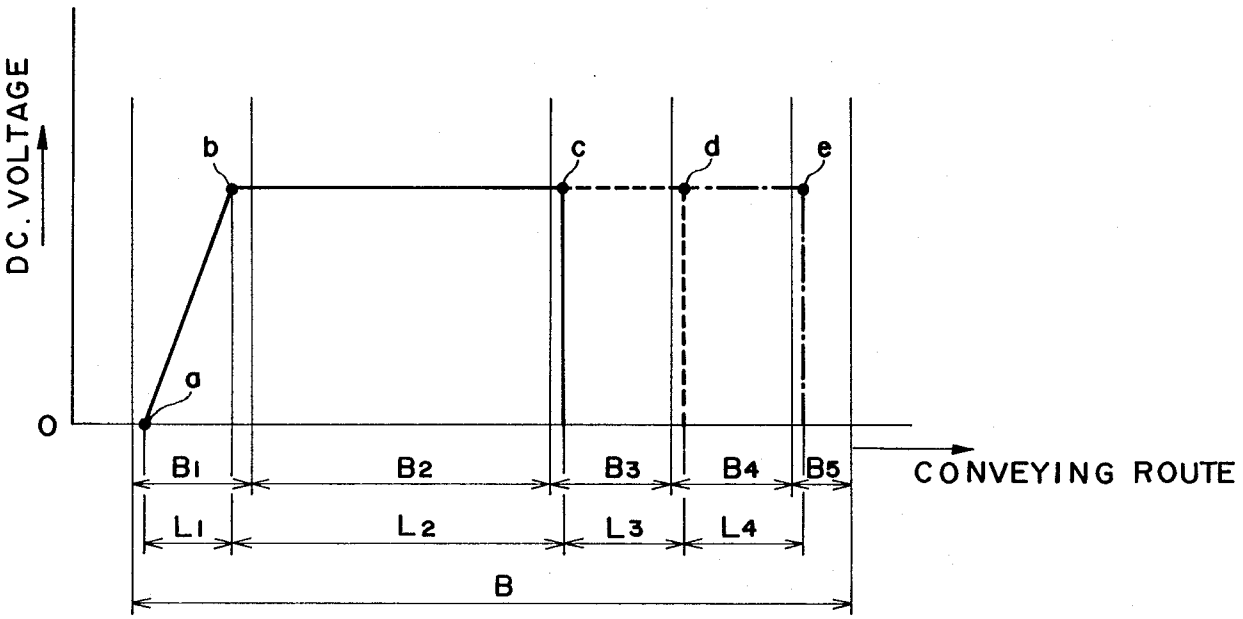
FIG. 2 is a graph showing the relationship between the position of a workpiece being conveyed and direct current voltage to be applied, in the apparatus shown in FIG. 1.

FIG. 1 shows an apparatus to be used for a method of electrodeposition coating according to a first embodiment of the present invention. FIG. 2 shows a pattern of voltage application in the apparatus. In this embodiment, voltage is applied after all the workpieces to be coated, which are hung from hangers, and having been conveyed in this manner, are completely submerged in the paint. Then, when terminating voltage application before the workpieces emerge from the paint, the difference of the hanger according to the type of workpiece is discriminated and the timing of termination voltage application to each hanger is changed according to the discriminated type of workpiece so that the most suitable length of time of voltage application for each hanger is assured, in order to provide the most desirable film thickness according to the type of workpiece.

Further, although this embodiment is an example of cathodic electrodeposition coating, it is also applicable to anionic electrodeposition coating.

In FIG. 1 numeral 1 shows an electrodeposition bath filled with paint 1*a*. Workpieces 4*a* and 4*b* to be coated are vertically arranged and hung from a hanger 3. Hanger 3 is connected to a conveyor 2 through insulator 5, and conveyor 2 is run along guiderail 2*a*. Workpieces 4*a* and 4*b* hung from hanger 3 are arranged in plurality and conveyed in succession along the conveying route. At the upper end of hanger 3 brush (otherwise called collector) 6 is attached, so as to come into contact with each of the bus bars to be mentioned hereafter.

Workpieces 4*a* and 4*b* are conveyed from the entrance side of bath 1 into the electrodeposition bath 1; and applied electrodeposition coating in the submersion area B in the bath 1 and; brought up and out of the bath 1 in order to be conveyed to the next process. According to the present embodiment, workpieces 4*a* and 4*b* reach the position where they are going to be immersed in the submersion area and the workpieces' arrival at the position is detected at the entrance side of the bath 1; and voltage is applied. Then, after the workpieces 4*a* and 4*b* have been conveyed to and completely immersed in the submersion area, they are transferred into the second zone of voltage application, thus voltage application continues and electrodeposition coating applied. Next, by detecting where voltage application to hanger 3 should be terminated, according to the type of workpieces hung from hanger 3, the zone in which voltage application shall be terminated is selected among zones B3, B4 and B5 so that the length of time of voltage application for respective hanger 3 will be determined to the most suitable length.

Workpieces 4*a* and 4*b* are conveyed by conveyor 2 along the guiderail 2*a* and start to enter the electrodeposition bath 1. The position where the workpieces submerge in the paint is detected by a limit switch LS1. In the conveying zone B1, which is within the span between one hanger 3 and the next hanger 3 (hanger pitch), voltage is applied to the workpieces 4*a* and 4*b* by bus bar 7 through brush 6 from the negative electrode side of a first rectifier 8 (a direct current generator). The positive electrode side of the first rectifier 8 is connected through cables to positive electrode plates 9 at the left and right sides in the electrodeposition bath and positive electrode plates (or electrode rod as the case may be) 10 facing the bottom of the electrodeposition bath. In this area B1 the boosting of voltage is initiated and direct current is applied between the workpieces 4a and 4b and the positive electrode plates, thus electrodeposition coating is applied.

Then, when the workpieces approach near the end of one hanger pitch from the initiation of complete submersion, their position is detected by a limit switch LS2, and the brush 6 is ready to be transferred to a second bus bar 11. At the time of this transfer sparks will be generated unless the electric potential of the bus bar 7 is identical to that of the second bus bar 11 connected to the negative electrode side of a second rectifier 12. For this reason, upon signal from the limit switch LS2, bus bar 7 and bus bar 11 become electrically connected through a connector 15 so as to make their electric potential identical, and sparks will not be generated at the time of transfer. When brush 6 has been transferred to bus bar 11, the position of the transferred brush 6 is detected by a limit switch LS3, and upon detection signal, connection through connector 15 is disconnected, and current to bus bar 11 is supplied from the second rectifier 12. Voltage application for electrodeposition coating is not interrupted at the time of this brush transfer, because brush 6 is so configurated as to allow electrical connection thereof simultaneously to both bus bars 7 and 11. Further, as the area B1, where power is supplied from the rectifier 8, is set narrower than the pitch of the hanger 3 (in other words the pitch of brush 6), it is always after preceding workpieces 4a and 4b enter the area B2, where power is supplied from the second rectifier 12, that succeeding workpieces 4a and 4b enter the power supplying area B1, where the same procedure of voltage boosting as described above is repeated. Thus, voltage application to the workpieces 4a and 4b, which are in the power supplying area B2, is not at all affected by boosting control in the power supplying area B1. As a result, the preceding workpieces 4a and 4b and the succeeding workpieces 4a and 4b receive voltage application of an identical amount under exactly the same condition.

In zone B2, positive electrode plates 13 and 14 are positioned, and workpieces 4a and 4b continue to receive electrodeposition coating by application of fixed voltage from the second rectifier 12.

When workpieces 4a and 4b are further conveyed for a certain fixed distance, the position just prior to transfer to a third bus bar 16 is detected by a limit switch LS4, brush 6 becomes ready to be transferred to the third bus bar 16. At this moment, the third bus bar 16 and the cable from the negative side of the second rectifier 12, i.e. the second bus bar 11, are electrically connected by a connector 17 so as to make their electric potential identical. In this manner, workpieces 4a and 4b are conveyed and transferred to the third bus bar 16 without causing sparks. Then the transferred position is detected by a limit switch LS5. In this embodiment, the type of workpieces 4a and 4b, in other words the differences between the hangers, are detected by some suitable means in order to determine the necessary length of time of voltage application. If the necessary length of voltage application is until the workpieces are in the B2 zone, connector 17 is disconnected and current supply to workpieces 4a and 4b from the second rectifier 12 is terminated. On the other hand, if current supply in the B3 zone is also necessary, the connector 17 continues its connection, and current supply to the workpieces 4a and 4b from the second rectifier 12 is not interrupted while they are conveyed through the third bus bar 16, thus electrodeposition coating is continued.

Then when the workpieces are further conveyed, the position where the brush is about to be transferred to a fourth bus bar 18 is detected by a limit switch LS6, and the workpieces become ready to be transferred to the fourth bus bar 18. At this moment, the electric potential of the third bus bar 16 and the fourth bus bar 18 is made identical. Namely, according to the condition as the aforementioned transfer (in other words the condition at the position of limit switch LS5), a connector 19 is disconnected if the connector 17 is switched off or; if the connector 17 is still in the connected condition and current is being supplied to the third bus bar 16, the connector 19 is connected to the negative side of the second rectifier 12 so that current is supplied to the fourth bus bar 18 to make its electric potential identical to that of the third bus bar 16. In this manner, the workpieces are conveyed and transferred to the fourth bus bar 18 without causing sparks. Then the transferred position is detected by a limit switch LS7 and at this time according to the condition as the aforementioned transfer (in other words the condition at the position of limit switch LS5), if the connector 19 is in a disconnected condition, the workpieces are conveyed with the connection still disconnected. On the other hand, if the connector 19 is in a connected condition, the type of workpieces 4a and 4b, in other words the difference of the hanger, is detected by some suitable means in order to determine the necessary time span of voltage application. And then, if the necessary time span of voltage application is until the workpieces are in the B3 zone, the connector 19 terminates the connection and current supply to the workpieces 4a and 4b from the second rectifier 12 is terminated. On the other hand, if current supply in the B4 zone is also necessary, connector 19 continues its connection, and current supply to workpieces 4a and 4b from the second rectifier 12 is not interrupted while they are conveyed through the fourth bus bar 18, thus electrodeposition coating is continued. It is possible, however, that the aforementioned means to detect the type of workpieces 4a and 4b is installed only as far as the B2 zone and that termination and continuation of current supply in and after B3 is controlled upon signals from the detection means.

Then when the workpieces are further conveyed, the position where the brush is about to be transferred to a fifth bus bar 20 is detected by a limit switch LS8, and brush 6 becomes ready to be transferred to the fifth bus bar 18. At this moment, upon a signal from limit switch LS8 the electric potential of the fourth bus bar 18 and the fifth bus bar 20 is made identical. According to the aforementioned condition (those at the position of limit switch LS7) a connector 21 terminates the connection if connector 19 is in a disconnected condition or; if connector 19 is still connected and current is being supplied to the fourth bus bar 18, connector 21 becomes connected to the negative side of the second rectifier 12 so that current is supplied to the fifth bar 20 with the identical electric potential as that of the fourth bus bar 18. In this manner, the workpieces are conveyed and transferred to the fifth bus bar 20 without causing sparks. Then the transferred position is detected by a limit switch LS9 and at this time, according to the aforementioned condition (those at the position of limit switch LS7), if connector 21 is in a disconnected condition, the workpieces are conveyed with the connection still disconnected. On the other hand, if connector 21 is in the connected condition, connector 21 becomes disconnected, thus terminating current supply to workpieces 4*a* and 4*b* from the second rectifier 12, and afterwards workpieces 4*a* and 4*b* start to emerge from the electrodeposition bath.

As described above, B1 is the current supply zone to receive current from the first rectifier 8; B2 is the current supply zone to receive current from the second rectifier 12 and; B3, B4 and B5 are the current supply control zones, where the type of workpieces 4*a* and 4*b* is detected and identified with every hanger and thus the length of time of voltage application is controlled by supplying and/or terminating current according to the type of workpieces.

Further, it is necessary to make the zones of the third bus bar 16 and the fourth bus bar 18, i.e. the distances between limit switch LS4 and LS6, and between limit switch LS6 and LS8, both narrower than the hanger pitch (distance between hangers) in order to control the time span of voltage application for each hanger.

FIG. 2 illustrates the pattern of application of direct current voltage to workpieces 4*a* and 4*b* in the apparatus shown in FIG. 1.

In the zone B1, when the limit switch LS1 has detected that workpieces 4*a* and 4*b* are ready to receive current through the first bus bar 7, boosting of the first rectifier 8 is initiated at point a. The boosting pattern may be in a straight line, as shown in FIG. 2, or, may be a curbed line: neither case will present any problem as long as the function of the apparatus is concerned. In the length L1 that is shorter than one hanger pitch, after the position of the hanger is detected detection by limit switch LS2, the circuit is connected by connector 15, thus, as shown with point b, workpieces 4*a* and 4*b* receive voltage application from the second rectifier 12. Then, the point where voltage is supplied from the second rectifier 12 to the workpieces is selected among points c, d and e shown in FIG. 2 according to the kind of the workpieces. The length of time of voltage application to workpieces, in other words current supply zone in and after B2, may be discretionally determined according to the kind of workpieces: for instance, L2 if point c is selected; L2+L3 in case of point d and; L2+L3+L4 in case of point e. In this embodiment, selection of point c, d or e is done as follows. After position detection by limit switches LS5 and LS7, the difference between hangers due to the type of workpieces is detected and recognized, and the point is decided whether connection of the connectors 17 and 19 should be continued or disconnected. The last point e shows the point where the circuit is disconnected by connector 21 upon detection of the position by limit switch LS9.

The method to detect and recognize the kind of workpieces may be the aforementioned method, which calls for detecting difference between the hangers that suspend the workpieces at each detected position by a limit switch, or; a method which calls for detecting and memorizing the type of workpieces or the difference between the hangers before the workpieces enter electrodeposition bath 1 and confirming the recognized information at every detected position by each limit switch.

Further, in this embodiment, since the first and second rectifiers are installed and boosting of voltage is initiated when workpieces have been completely submerged in the paint, massive current flow at the time the workpieces enter the bath is prevented and there will be no miscoating, such as pinholes, irregular surface caused by unstable current application, etc.

The result of performance of the apparatus used in a method according to this first embodiment of the present invention will be described.

The size of the electrodeposition bath 1 used is 2500 mm wide from the left side to the right side and 28000 mm long along the conveying route, the pitch of the hanger 3 is 3000 mm, and vehicle parts are used for workpieces to be coated. The workpieces are arranged and hung within an area of 2000 mm long, 1200 mm wide and 1400 mm high. At the points where the workpieces enter and emerge from the bath 1, the angle of the conveyor rail is 20° off the horizontal. The first bus bar is 2500 mm long, the second bus bar 5000 mm long, the third bus bar 2500 mm long, the fourth bus bar 2500 mm long and the fifth bus bar 500 mm long. For electrode plates, diaphragm electrodes are used for those facing the sides of the bath and bare electrodes are used for those facing the bottom of the bath. The conditions of electrodeposition coating in the electrodeposition bath are as follows;

Paint: Paint for cathodic electrodeposition coating
Concentration of paint: 19–21%
Temperature of paint: 26–28° C.
Coating voltage: First rectifier; OV - 300 V/30 sec.
Second rectifier; 300 V constant
Conveying speed: 2.5 m/min.

The relationship between the length of time of voltage application and the thickness of the outside electrodeposition film obtained as a result was 30–32 μm when current was applied for 3 minutes, 34–36 μm for 4 minutes and 37–39 μm for 5 minutes. It was proven possible to control film thickness by selecting the length of time for voltage application for each hanger. Further, the film surface was smooth and in satisfactory condition, and there was no generation of sparks.

Second Embodiment

Figure 3:
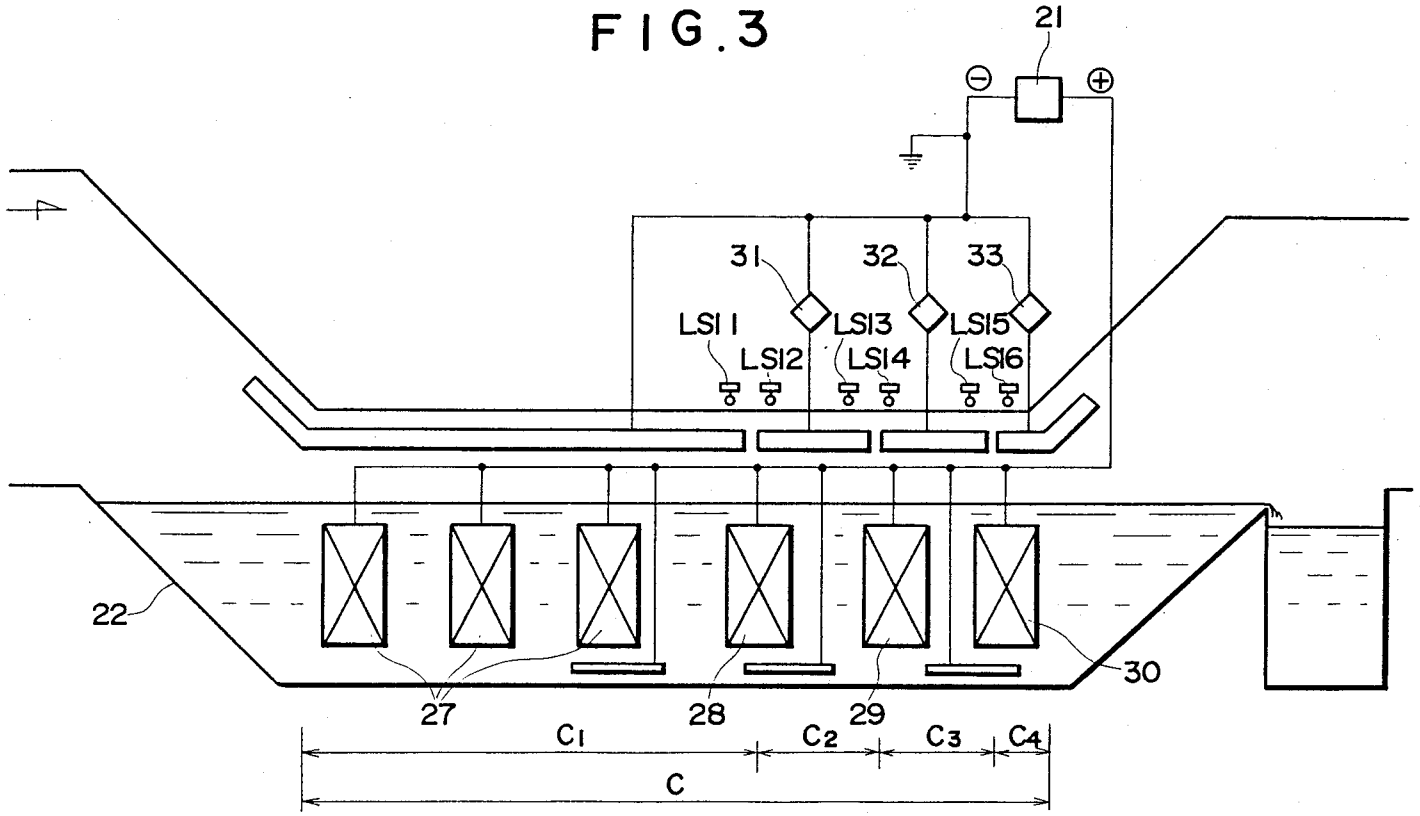
FIG. 3 is a schematic side view of an electrodeposition coating apparatus to be used in a method for electrodeposition coating according to a second embodiment of the present invention.

Second embodiment of the present invention is illustrated in FIG. 3.

In FIG. 1, in order to supply power only when the workpieces are submerged in the paint, the embodiment illustrated has two stages of power supply; the first rectifier and the second rectifier. However, it is also possible to embody the present invention also in a case as shown in FIG. 3, i.e. in case where a single rectifier is used; in FIG. 3 a rectifier 21. The process in this second embodiment is essentially the same as the procedure at and after the second bus bar in FIG. 1. More specifically, submersion area C in an electrodeposition bath 22 is divided into zone C1, C2, C3 and C4, corresponding to multi-staged bus bars 23, 24, 25 and 26 respectively. Positive electrode plates 27, 28, 29, and 30 are positioned in each zone C1, C2, C3 and C4. Transfer from one zone to another is detected and controlled by limit switches LS11, LS12, LS13, LS14, LS15 and LS16 respectively. Power supply at the time of transfer and determination as to which zone power supply should be continued to is controlled by connectors 31, 32 and 33. Further, in the apparatus shown in FIG. 3 voltage is already applied when the workpieces to be coated enter the bath and may be continually applied when they emerge out of the bath.

All other configurations and functions are essentially the same as those in the first embodiment.

Further, it is obvious that in both of the aforementioned embodiments the number of bus bars may be changed as needed.

Furthermore, application of the present invention is also applicable to workpieces other than vehicle parts, including vehicle bodies and other kinds of parts.

As hitherto described in detail such effects and merits as follows are obtained by electrodeposition coating according to the method of the present invention.

As the time span of voltage application for electrodeposition coating to each workpiece is controlled according to the type of the workpiece, it is possible to change the length of time required for voltage application to each hanger and thus to provide each workpiece with electrodeposition coating of the most suitable film thickness even in a line where electrodeposition coating for workpieces of varied film thickness required are present. Because of this effect, it becomes possible to eliminate excess thickness of paint film on some workpieces which are, according to conventional method, subject to receive electrodeposition under conditions set for other workpieces which are deemed more important; and it also becomes possible to eliminate paint waste.

Furthermore, as it is possible to simultaneously submerge workpieces hanging from a plurality of hangers while controlling electrodeposition film thickness according to the type of workpieces, even when workpieces whose desired thickness of coating differ form each other are present on the same line, they can be conveyed with short conveying pitches and receive electrodeposition coating in a continuous process, thus high production efficiency can be obtained.

Although several preferred embodiments of the present invention have been described in detail, it will be appreciated by those skilled in the art that various modifications and alterations can be made to the particular embodiments shown without materially departing from the novel teachings and advantages of this invention. Accordingly, it is to be understood that all such modifications and alternations are included within the scope of the invention, provided they come within the scope of the appended claims and their equivalents.

What is claimed is:

1. A method of coating each of a plurality of different types of workpieces spaced from each other in the direction of conveyance, with a different coating thickness while being continuously conveyed through an electrodepositon bath having a submersion area of sufficient dimension to completely submerge at least two of said spaced plurality of workpieces at one time, each of said spaced plurality of workpieces having a conveyor carried electrode, and a plurality of successive current stages including selectable current stages disposed in the direction of conveyance and operative to be electrically coupled to the current carrying electrodes of the submerged workpieces, said method comprising the steps of:

detecting the type of spaced workpieces being conveyed for selecting a required thickness of electrodeposition coating on each of said plurality of workpieces;

selecting different ones of said plurality of selectable current stages for each different detected type of spaced workpieces;

conveying the spaced workpieces through the electrodeposition bath at a substantially uniform rate;

providing a fixed voltage for the selectable current stages; and electrically coupling said fixed voltage to said selected ones of said plurality of selectable current stages for controlling the length of time said fixed voltage is applied to each respective workpiece in the electrodeposition bath.

2. The method of claim 1 wherein, each of the plurality of successive current stages comprises a bus bar spaced from an adjoining bus bar in the direction of travel of the plurality of workpieces, said total length of said spaced bus bars corresponding to the total length of the submersion area of the electrodeposition bath.

3. The method of claim 1 wherein, the step of selecting successive current stages comprises selecting the final stage in the direction of conveyance of the workpieces.

4. The method of claim 1 wherein the step of electrical coupling, comprises:

electrically coupling one stage to an adjacent stage in the direction of conveyance while the workpiece is approaching the adjacent stage.

5. The method of claim 1 wherein, the electrodeposition coating is a cathodic electrodeposition coating.

6. The method of claim 1 wherein, the distance between each of the plurality of spaced workpieces is greater than the length of at least a first and final one of the plurality of successive current stages.

* * * * *